US005167415A

United States Patent [19]

Iandola

[11] Patent Number: 5,167,415

[45] Date of Patent: Dec. 1, 1992

[54] GOLF SWING TRAINING CLUB

[76] Inventor: John Iandola, 5845 S. Blackstone Ave., Chicago, Ill. 60637

[21] Appl. No.: 851,867

[22] Filed: Mar. 16, 1992

[51] Int. Cl.[5] ..... A63B 69/36

[52] U.S. Cl. ..... 273/186.2; 273/193 R

[58] Field of Search ..... 273/186 A, 186 C, 186 R, 273/186 B, 186 D, 186 E, 193 R, 193 A, 193 B, 194 R, 194 A, 183 D, 183 E; 434/252

[56] References Cited

U.S. PATENT DOCUMENTS

| | | | |
|---|---|---|---|
| 2,462,955 | 3/1949 | Glancey | 273/193 A |
| 3,109,244 | 11/1963 | Trifaro et al. | 273/193 R X |
| 4,145,054 | 3/1979 | Stewart | 273/186 A |
| 4,148,096 | 4/1979 | Haas et al. | 362/252 |
| 4,170,356 | 10/1979 | Banks | 273/186 A |
| 4,411,431 | 10/1983 | Judice | 273/183 C |
| 4,582,325 | 4/1986 | Yuhara | 273/186 A |
| 4,595,204 | 6/1986 | Patterson | 273/186 A |
| 4,693,479 | 9/1987 | McGwire | 273/186 A |
| 4,913,441 | 4/1990 | Freer | 273/186 A |

*Primary Examiner*—George J. Marlo
*Attorney, Agent, or Firm*—Silverman, Cass & Singer

[57] ABSTRACT

A golf swing training device having a pair of unequal length golf club shafts connected end-to-end along a common axis. The shorter length shaft has a golf grip at one end thereof and a simulated plastic golf ball attached to its opposite free end. The longer shaft has a return bend therein adjacent the end thereof connected to the shorter shaft and a simulated or plastic golf ball attached to its opposite free end. The simulated golf ball on the shorter shaft is used to sight on a golf ball or target on the ground before the golfer when he addresses the grounded ball. The golfer then performs the backswing, the downswing and the follow-through in a practice swing during which the simulated golf balls should traverse the two planes desired for the golfer's swing and provide feedback to the golfer relating to his practice swing without contacting the grounded golf ball. The training club is suitable for practicing club swings for both so called "woods" and "irons". The ratio between the length of the shorter shaft and length of the longer club is selected whereby to teach the golfer the correct swing of the club from backswing to follow-through by means of the feedback information from the plastic balls passing the grounded ball.

7 Claims, 1 Drawing Sheet

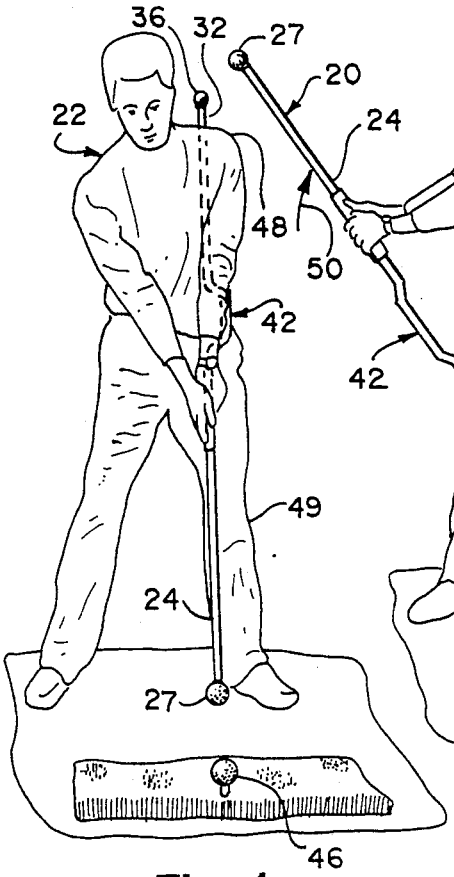
Fig. 1
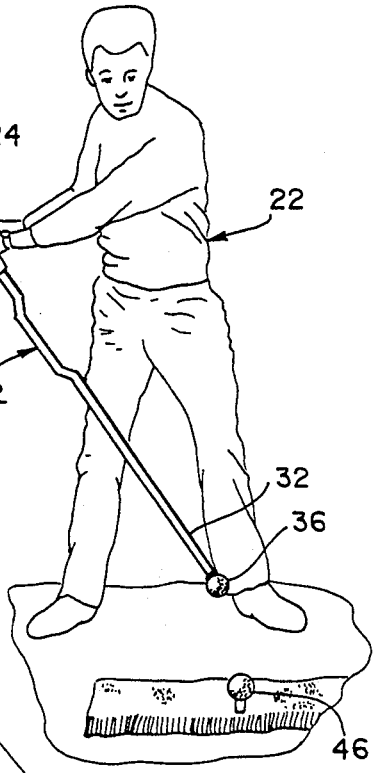
Fig. 2
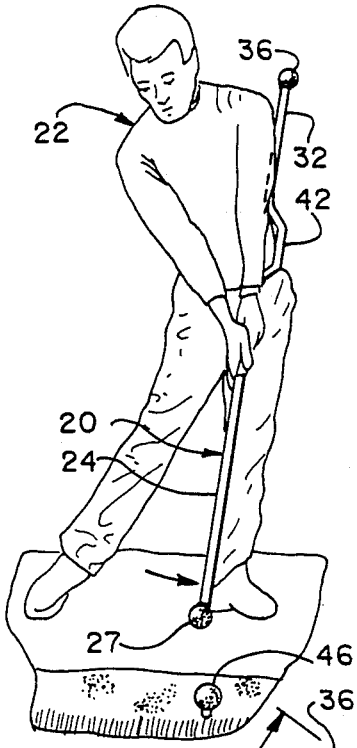
Fig. 3
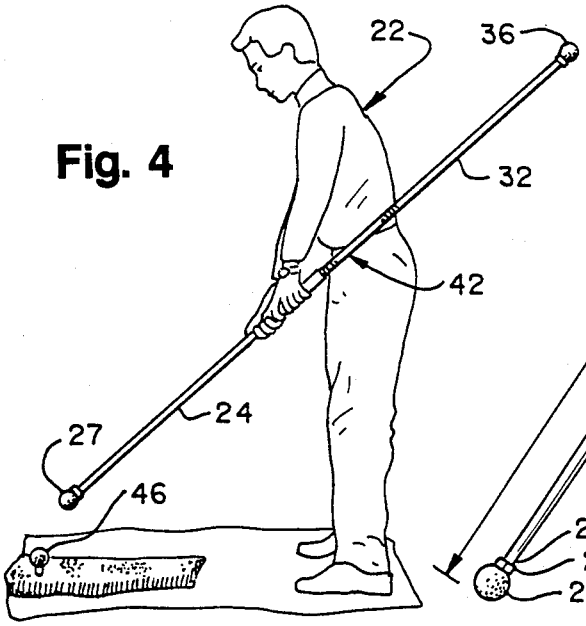
Fig. 4
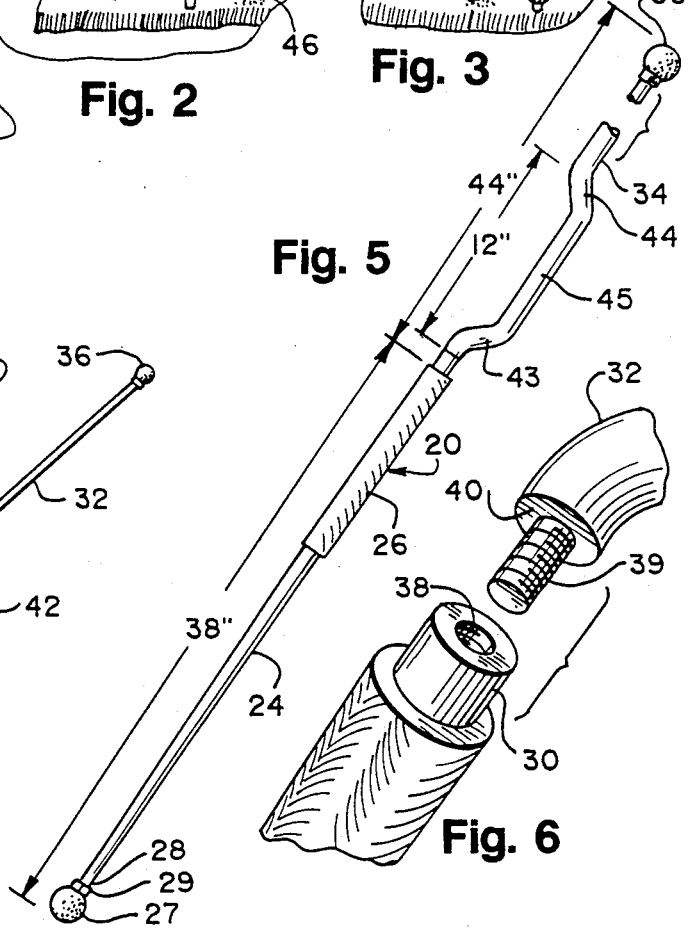
Fig. 5
Fig. 6

GOLF SWING TRAINING CLUB

FIELD OF THE INVENTION

This invention relates to a training device for improving a golf swing and more particularly, provides a golf swing training club which employs simulated golf balls attached at opposite ends of the club which traverse the plane of the golfer's swing and provide feedback to the golfer relating to his completed golf swing without contacting the ball. The training club embodying the invention is suitable for training in the proper swing both for so called "woods" or distance clubs and the "irons".

BACKGROUND OF THE INVENTION

The golf swing is a complicated movement to execute properly through the sequences of the backswing, downswing and follow-through. Some of the factors which contribute to an improper golf swing are improper stance or positioning relative to the golf ball to be struck, improper pivoting, and improper positioning of the hands and elbows during the golf swing. An excellent discussion of the difficulties required to be overcome in order to achieve a proper golf swing consistently is provided in U.S. Pat. Nos. 4,145,054, 4,170,356, 4,582,325, 4,595,204, 4,693,479 and 4,913,441.

In U.S. Pat. No. 4,693,479, the golf swing training device 14 provides a visual indication of the position of the golf club during the backswing and downswing by sighting on the golf ball and the surface or area immediately surrounding the golf ball. The device 14 employs a light source mounted to the golf grip to provide a light beam which can track the path of the club head during the swing while the golfer, hopefully, keeps his head focussed on the ball.

In U.S. Pat. No. 4,913,441, the complex flight of the golf ball hit by a golf club is explained. The correct of the positioning of the swing plane of the golf club along what is referred to as "the target line" is essential in order to attain the desired direction and distance of the ball from the golf swing. In this patent, a laser light source is provided in the golf grip which projects a light beam out of the top of the golf grip to track the swing of the training device and provide feedback to the golfer relating to his swing.

In U.S Pat. Nos. 4,145,054, 4,170,356 and 4,582,325, mechanical implements are attached to the golf club for teaching proper swing of the club.

In U.S. Pat. No. 4,595,204, the training device 21 employs a golf club 25 having a grip or handle over which an extension tube 35 is fitted. The extension tube 35 has a socket into which a centering pin is fitted for proper attachment of the extension tube. The golf club 25 has a club head which is intended to strike a ball on the downswing of the club 25. The length of the extension remains constant regardless of the length of the club 25 which may vary. The club 25 is a hollow plastic member. The free end of the extension tube has no indication means relating to achieving a proper golf swing.

The training club embodying the invention overcomes the problems attendant the use of a light source in the golf club and the use of mechanical attachments which are cumber some and subject to distortions and damage during use and/or improper storage thereof. The use of a light source raises problems with respect to breakage when the club strikes the ball on the ground during a golf swing. The requirement for replacement of batteries also is a disadvantage. The devices using a light source tend to be relatively expensive also. Likewise, the use of special mechanical attachments can be expensive.

The training club embodying the invention employs a standard golf club shaft having a golf grip and a second standard golf club shaft constructed and arranged to be secured to the end of the standard club shaft adjacent the grip. Each free end of the connected attached shafts has a plastic or simulated golf ball attached thereon. The golf ball attachments serve as information feedback means to the golfer as to whether his address to a golf ball on the ground before him and his subsequent backswing, downswing and follow-through were properly executed. Preferably, the two shafts are of specially selected lengths to realize a desired ratio of their relative lengths one to the other. The shafts may be detachably connected end-to-end for convenient separation and storage until put into use by the golfer.

The longer shaft has a shaped bend which enables achieving the desired proper stance when the golfer addresses a practice ball on the ground before him.

SUMMARY OF THE INVENTION

A golf swing training device having a pair of unequal length golf club shafts connected end-to-end along a common axis. The shorter length shaft has a golf grip at one end thereof and a simulated or plastic golf ball attached to its opposite end. The longer shaft has a shaped bend adjacent the end thereof connected to the shorter shaft and a simulated plastic golf ball attached to its opposite end. The simulated golf ball on the shorter shaft is used to sight on a golf ball or target on the ground before the golfer when he addresses the grounded ball. The golfer then performs the backswing, the downswing and the follow-through in a practice swing during which the simulated golf balls should traverse the two planes of the golfer's swing and provide feedback to the golfer relating to his practice swing without contacting the grounded golf ball in order to achieve a correct golf swing. The training club is suitable for practicing club swings for both so called "woods" and "irons". The ratio between the length of the shorter shaft and length of the longer club is selected whereby to teach the golfer the correct swing of the club from backswing to follow-through.

In the preferred embodiment of the invention, the length of the shorter shaft is 36" and the length of the longer shaft is 44". The shafts preferably are detachably connected end-to-end for convenient storage dissembled and ready reassembly into the training club.

BRIEF DESCRIPTION OF THE DRAWINGS

FIG. 1 is a diagrammatic front elevational view illustrating a golf in the address stance to the grounded golf ball using the golf swing training club embodying the invention.

FIG. 2 is a diagrammatic front elevational view of the golfer of FIG. 1 executing the backswing in a practicing swing using the invention.

FIG. 3 is a diagrammatic front elevational view of said golfer executing the downswing in a practice swing using the invention.

FIG. 4 is a diagrammatic side elevational view of the golfer in the golf ball address stance illustrated in FIG. 1.

FIG. 5 is a side elevational view of the golf swing training club embodying the invention.

FIG. 6 is a fragmentary exploded view illustrating an example of detachable connector means for joining the separate golf shaft components of the invention.

DESCRIPTION OF A PREFERRED EMBODIMENT

The training device designated generally by the reference character 20 embodying the invention would be used by a golfer 22 for practicing to improve and/or correct his golf swing. The training device 20, illustrated in FIG. 5, includes a hollow metal shaft member 24 which has a golf grip 26 but does not have a club head at its distal or opposite end such as a conventional golf club would have. The shaft member comprises a conventional metal golf club shaft which has been modified for its functions in the training device 20, yet, which provides for the desired feel of a conventional golf club during the practice swinging of device 20.

The shaft member 24 includes a simulated or plastic golf 27 ball attached at its distal end 28 by means of a nut 29 and a connecting pin (not shown) embedded in the ball, as illustrated in FIG. 5. The golf grip 26 is secured adjacent the end 30 of shaft 24 as in a conventional golf club.

Secured to the end 30 of shaft 24 is a second hollow metal shaft 32. The shaft 32, likewise, is a conventional shaft of a golf club and is so secured end-to-end to the shaft 24 to constitute an extension thereof To the distal end 34 of the shaft 32 is secured a simulated or plastic golf ball 36 in a manner similar to the manner in which the plastic ball 27 is attached to the distal end 28 of the shaft 24.

One manner of securing the shafts 24 and 32 together end-to-end is illustrated in FIG. 6. The end 30 of shaft 24, shown exposed above the grip 26, is threaded internally as at 38 to accommodate the threaded shank 39 extending from the end 40 of shaft 32. Thus, the shafts 24 and 32 can be detachably connected end-to-end by threadedly engaging the shank 39 into the internally threaded end 30 of shaft 24.

The shafts 24 and 32 are of different lengths selected to provide a desired ratio between their respective lengths. The shaft 24 preferably is 38" in length whereas the selected length of shaft 32 is 44". This is shown in FIG. 5. Shaft 32 has a generally U-shaped or return bend 42 in close proximity to end 40 thereof. The bend 42 is formed by the two opposing legs 43, 44 between which the segment 45 is connected. The bend 42 preferably has a depth of approximately 3–4" whereas the span of the bend is approximately 12". In the address stance shown in FIG. 1 and the downswing shown in FIG. 3, the bend 42 provides for clearing the hip of the golfer. The bend 42 permits the remaining length of shaft 32 to be coaxial with shaft 24, again as seen in FIG. 5 and proper gripping and positioning of the device in the golfer's address stance to a grounded golf ball 42 seen in FIGS. 1–4.

The manner of performing the practice swing of the device 20 is illustrated in the sequence of FIGS. 1–3. In FIG. 1, the golfer 22 represents a typical right handed golfer assuming a normal address stance relative to the grounded ball 46. The shaft 24 is positioned so that the plastic ball 27 is aligned with the grounded ball 26 and spaced therefrom at an angle. The longer shaft 32 is positioned behind the right shoulder 48 of the golfer with the return-bend 42 clearing the left hip of the golfer. The positioning of the grounded ball 46 relative to the left leg 49 of the golfer will be determined by the type of "wood" or "iron" club the golfer decides to use for his practice swing.

In FIG. 2 the golfer 22 commenced his backswing in a slow, deliberated movement in which the golfer's head is not moved. The shaft 32 has been moved from behind the back of the golfer to where the plastic ball 36 is in the same registry position relative to the grounded ball 46 as illustrated in the address stance position of FIG. 1. This indicates the desired targeting on the golf ball 46 in the backswing. The backswing will be completed in the direction of the arrow 50; the extent of the continued movement again will depend upon the type of club selected for the practice swing. For instance, for a "wood" club, the shaft 24 may be moved to a position behind the head of the golfer. For a short "iron" practice swing, the shaft 24 may not be moved any more.

In FIG. 3, the downswing of the device 20 is illustrated in the direction of the arrow 52. The right elbow of golfer 22 has been dropped by the pull of the left arm and both arms of the golfer are extended with the left arm straight at the bottom of the downswing. Here, the plastic ball 27 is shown aligned with and spaced from the ball 46 to the same positioning as shown for the ball 27 relative to ball 46 in FIG. 1. The follow-through has not been shown. The plastic ball 27 does not contact the ball 46 in completing the downswing and the follow-through.

If the practice swing results in the plastic ball 36 hitting ground, the backswing has been improper. The same holds true if the plastic ball 27 hits ground in the downswing.

It will be appreciated that in the backswing, the plastic balls 27 and 36 will be moving slowly. The ball 36 will be somewhat of a blur in the backswing, but when is passes the grounded ball 46 in the backswing shown in FIG. 2, the golfer still will get a feedback of information as to how the practice swing is progressing. The golfer still can focus on the ball 46 and still become aware of the proper swing path on the backswing.

In the downswing, the ball 27 will, of course, be moving faster. Yet, by concentrating on the grounded ball 46, the golfer can still be aware of the blurred movement of the plastic ball 27 past the grounded ball 46. The blur images created by the two plastic balls 27 and 36 during the practice swing provide feedback information that the correct practice swing defines two planes. The first of the planes is the swing path on the outside plane and second swing path which is the plane closer to the both of the golfer. The golfer receives a better feel for the two proper swing planes of the golf club. The increased length of the longer shaft 32 relative to the shorter shaft 24 enables the targeting of the plastic ball 36 on the grounded ball 46 during the backswing, as explained herein. This ratio between the lengths of the shafts 24 and 32 is important to achieving the desired targeting on the grounded ball 46 by plastic balls 27 and 36.

The device 20 is collapsible for ready storage and assembly. The use of conventional golf club shafts 24 and 32 contributes to a more normal feel for the club 20, as though it was just another golf club. The use of the plastic balls 27 and 36 enables the golfer to keep his head focussed on the grounded ball 46 during each part of the practice swing.

The device 20 can be used equally by a left handed golfer.

I claim:

1. A golf swing training device comprising a pair of unequal length golf club shafts connected end-to-end along a common longitudinal axis, each shaft having a free end and a simulated golf ball attached to each free end, the shorter length shaft having a golf grip adjacent to the end-to-end connection of said shafts.

2. The device of claim 1 in which said longer length shaft has a return bend therein adjacent said end-to-end connection of said shafts.

3. The device of claim 2 in which said bend is generally U-shaped in configuration.

4. The device of claim 1 in which said shafts have cooperating detachable connector means which permit separating said shafts for convenient storage during nonuse thereof.

5. The device of claim 3 in which said means comprise a screw threaded nut and threaded shank, on said shafts respectively.

6. The device of claim 3 in which said nut is slidable on the longer shaft and said shank is provided on the end of said shorter shaft opposite said free end thereof.

7. The device of claim 1 in which the length of the shorter shaft is approximately 36" and the length of the longer shaft is approximately 44".

* * * * *